United States Patent [19]

DeCamp et al.

[11] 4,408,562

[45] Oct. 11, 1983

[54] APPARATUS FOR APPLYING A COATING TO A MOVING SURFACE

[75] Inventors: James E. DeCamp, Olympia Fields; Raymond J. Arndt, Chicago; Ronald L. Gruzewski, Tinley Park, all of Ill.

[73] Assignee: Mactron, Inc., Worth, Ill.

[21] Appl. No.: 332,947

[22] Filed: Dec. 21, 1981

[51] Int. Cl.[3] ..... B05B 12/04

[52] U.S. Cl. ..... 118/669; 118/677; 118/702; 118/682; 118/324

[58] Field of Search ..... 222/148; 118/669, 677, 118/678, 682, 684, 25, 702, 324; 239/120, 104

[56] References Cited

U.S. PATENT DOCUMENTS

| | | | |
|---|---|---|---|
| 3,177,846 | 4/1965 | Archer et al. | 118/25 |
| 3,876,144 | 4/1975 | Madden et al. | 118/302 X |
| 4,164,001 | 8/1979 | Patnaude | 118/684 X |

*Primary Examiner*—John P. McIntosh
*Assistant Examiner*—Mary Beth Fennell
*Attorney, Agent, or Firm*—Trexler, Bushnell & Wolters, Ltd.

[57] ABSTRACT

Apparatus for applying a coating to a surface of a moving workpiece comprises a coating dispenser having at least one coating outlet spaced apart from the workpiece surface for dispensing a stream of coating. A dispenser control unit is operatively coupled with the dispensing means for initiating and terminating the dispensing of the stream of coating as predetermined parts of the workpiece surface come into alignment with the coating outlet. The invention provides an anti-tailing device coacting with the stream of coating intermediate the outlet and the workpiece surface for substantially preventing tailing of the stream of coating following termination of dispensing thereof.

19 Claims, 9 Drawing Figures

APPARATUS FOR APPLYING A COATING TO A MOVING SURFACE

BACKGROUND OF THE INVENTION

The present invention is directed generally to the coating arts and more particularly to a novel non-contact coating apparatus for applying a coating to a surface of a moving workpiece.

While the invention may find utility in other applications, the disclosure will be facilitated by reference to the non-contact application of a liquid glue medium to a moving substrate such as a paper carton, in a desired pattern. In the manufacture of folding paper cartons and the like it is desirable to apply glue to predetermined surfaces of the carton and in predetermined patterns for use in later erecting and assembling the carton.

Heretofore, primarily contact methods of gluing have been used in this application. In one contact method, a glue applicator in the form of a roller or like apparatus contacts the surface of each carton as a plurality of cartons move down a conveyor. However, the contact method of glue application has a number of drawbacks, for example, this method is messy and difficult to control.

In many instances, the limitations of the gluing wheel may be circumvented by replacing it with a controllable extruding applicator which rides upon the surface of the substrate and is maintained in contact with the substrate by a spring loading arrangement. Most often, this applicator is pneumatically operated with the pneumatic system being controlled in turn by an electrically actuated pilot valve. By driving the pilot valve from an appropriate electronic controller, it is possible to lay down a desired glue pattern. Such systems have been employed successfully in many applications, most notably the gluing of corrugated cartons. However, their usefulness at high surface speeds is limited by the relatively slow response of the electropneumatic components as well as by the dynamics of the suspension which maintains the contact between the applicator and the substrate. Moreover, this approach is not suitable for use with more delicate media, such as small folding cartons, which are normally run at higher speeds and which are unable to sustain the forces imposed by the spring-loaded applicator. In such situations, attempts to employ a surface-riding applicator are likely to result in damage to the cartons and/or frequent jamming of the cartons in the transport.

As a solution to the foregoing problems, non-contact extrusion gluing systems have been proposed. In such systems, a nozzle-type applicator is generally spaced some distance above the surfaces of the cartons on the conveyor for applying glue in the desired pattern. However, problems have also arisen with the non-contact system. For example, some delay is inherent between the release of glue from the nozzle and its impingement upon the surface of the carton. Hence, proper timing of the opening and closing of a valve feeding the dispensing nozzle is required to compensate for this delay and ensure the proper disposition of the desired pattern upon the carton surface. As the speed of the conveyor increases, this compensation becomes increasingly important.

Moreover, it is a significant problem in non-contact gluing devices to secure an accurate and well-defined termination of a glue bead. This problem is largely one of "tailing" of the glue bead deposited on the carton surface following the shut-off of the dispensing nozzle valve. By "tailing" is meant the tendency of the remaining glue both in the nozzle and in the space between the nozzle and the carton surface to be drawn out into a long, thin tail after the closing of the valve. This is because the closing of the valve results in loss of pressure driving the glue to the carton. Hence, the continued movement of the conveyor, and hence carton, past the nozzle, coupled with the rapidly decreasing velocity of the remaining glue tends to draw out this remaining glue in a relatively long tail on the surface of the carton.

Such a tail is undesirable as it causes glue to be applied to parts of the carton outside of the selected or desired glue pattern. This undesired tailing may take the form of either a continuous tapering trail of glue or may break up into a number of individual globules with spaces therebetween. In any event, extension of the glue bead beyond the desired limits creates serious problems in most applications. Often, it will result in tacking together portions of the carton which should be free of one another or cause the carton to jam in the automatic machinery which handles it for filling. Hence, such tailing is a substantial problem because of the delays and shutdowns it causes later in the automated carton erection and filling operations.

Merely setting the timing of glue valve closing to allow this tail to serve as the final portion of a glue bead or pattern has been found to be unsatisfactory. Firstly, as mentioned, the tail produced is generally inconsistent, and cannot be relied upon to provide a reproducible pattern or bead. Moreover, the end of the bead formed by a tail tends to be lacking in strength because of the diminishing quantity of glue. A carton in which some portions are not fully glued can be equally unacceptable to one in which glue is applied at undesired portions.

This problem of tailing increases with increased velocity of the conveyor carrying the cartons past the glue application nozzle. Additionally, the problem increases as the separation or spacing between the nozzle and the carton surface increases. However, greatly decreasing this latter spacing is not acceptable as it eliminates the desired tolerance for boxes which may be slightly higher or lower upon the conveyor, and thus gives rise to similar problems of jamming encountered in contact gluing applications as described above. Running a gluing line at sufficiently low surface speed to minimize the tailing problems is also unacceptable from a standpoint of productivity.

The presence or absence of a glue tail is also affected by the glue viscosity, the orifice diameter of the nozzle and the pressure of the glue fed to the nozzle. However, control of these parameters is often severely limited by the application. For example, the parameters of viscosity, orifice diameter and glue pressure also affect the size and quality of the glue bead deposited. Hence, it is not realistic to resolve the tailing problem at the cost of the desirable properties of the main glue beads being deposited. Moreover, a relatively small orifice which would tend to minimize the tailing problem would also be highly susceptible to clogging by dirt particles or by the glue itself. Also, a relatively small orifice would result in a relatively fine glue stream which would be more susceptible to external influences such as aerodynamic drag, or the like, especially in the space between the glue nozzle orifice and the surface of a carton. Since the glue orifice, viscosity and pressure are interdependent, the requirements dictating any one of these parameters tends to fix the possible values of the other two. Unfortunately, requirements of a particular application including the production rate, machine tolerances and vibrations, and need for particular glue bead characteristics peclude realization of the necessary combination of parameters to avoid the problem of tailing in most applications.

OBJECTS AND SUMMARY OF THE INVENTION

It is a general object of the invention to provide a novel and improved apparatus for applying a coating to a moving surface which substantially avoids the problems of the prior art.

A more specific object is to provide a non-contact gluing apparatus for applying glue in a desired pattern to a moving surface.

A further object is to provide an apparatus in accordance with the foregoing objects which substantially avoids the tailing problem of the prior art.

A related object is to provide an apparatus in accordance with the foregoing objects which may be readily added to existing non-contact gluing apparatus without requiring modification thereof.

Yet another object is to provide apparatus according to the foregoing objects which is relatively simple and inexpensive in its design and manufacture and yet highly reliable in operation.

Briefly and in accordance with the foregoing objects, the invention provides apparatus for applying a coating to a surface of a moving workpiece comprising coating dispensing means having at least one coating outlet spaced apart from said surface for dispensing a stream of coating, dispensing control means operatively coupled with said dispensing means for initiating and terminating the dispensing of said stream of coating as predetermined parts of said workpiece surface come into alignment with said coating outlet and means coacting with said stream of coating intermediate said outlet and said surface for substantially preventing tailing of said stream of coating following termination of dispensing thereof.

BRIEF DESCRIPTION OF THE DRAWINGS

The foregoing, as well as other objects, features and advantages of the invention will be more readily appreciated upon reading the following detailed description of the illustrated embodiment, together with reference to the drawings, wherein.

DETAILED DESCRIPTION OF THE ILLUSTRATED EMBODIMENT

Figure 1:
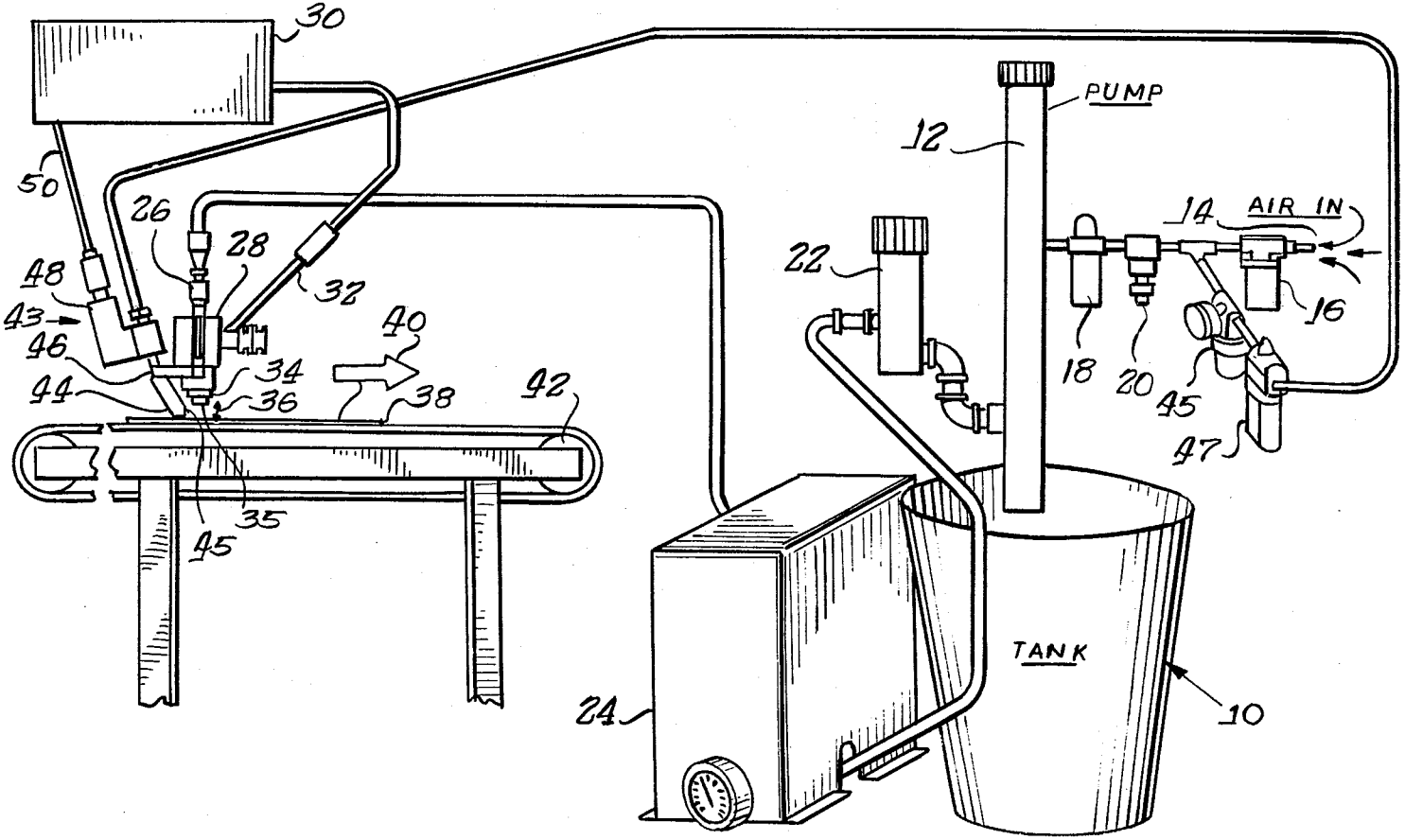
FIG. 1 is a side elevation, partially schematic in form, illustrating apparatus according to the invention.

Referring to the drawings and initially to FIG. 1, there is seen a non-contact glue dispensing system. In accordance with conventional practice, the system includes a tank or reservoir 10 holding a supply of glue or other coating to be applied. The glue or other coating material from the tank 10 is fed out by way of a conventional pump 12 preferably powered by pressurized air admitted at an inlet 14. Conventional components including a filter 16, a lubricator 18 and a pressure regulator 20 are also provided in this regard.

A suitable filtering component 22 may also be interposed between the pump 12 and a conventional fluid pressure regulator 24 for regulating the pressure of the glue supplied from the tank 10 from the pump 12. This pressure regulator 24 feeds an inlet 26 of a solenoid operated valve 28. This valve 28 is open and closed in accordance with electrical control signals from a control apparatus or controller 30 fed thereto over a suitable cable 32. In response to control signals received from the controller 30, the solenoid operated valve 28 alternatively delivers or shuts off a flow of glue to a nozzle 34. In accordance with conventional non-contact gluing practice this nozzle 34, and in particular the outlet 35 thereof, is spaced apart a preselected distance 36 from the surface of a workpiece 38 to which glue is to be applied. In the illustrated embodiment this workpiece 38 comprises a folding carton.

This workpiece or carton 38 is carried in a direction 40 by a conventional conveyor 42 which carries a plurality of cartons such as the carton 38 in spaced apart sequence thereon so as to sequentially apply glue to the upper surfaces thereof from the nozzle 34 in a predetermined, controlled pattern. The control system 30, as will be seen later, is suitably coordinated with the motion of the cartons 38 along the conveyor 48 relative to the nozzle 34 for opening and closing the valve 28 at the proper intervals to apply the desired patterns.

Departing from convention and in accordance with the invention, a novel anti-tailing structure 43 is provided which cooperates with the glue nozzle 34 for substantially preventing trailing of glue upon the cartons 38, etc., subsequent to the valve 28 terminating the supply of glue to the nozzle 34. In the embodiment illustrated in FIG. 1, this novel anti-tailing structure 43 includes a further orifice or nozzle 44 mounted adjacent to the glue delivery nozzle 34. In the illustrated embodiment, this nozzle 44 is mounted to the structure including the glue nozzle 34 and valve 28 by means of a suitable bracket 46. The nozzle 44 delivers a stream of pressurized air at an appropriate time following the closing of the valve 28 so as to prevent tailing of the glue stream delivered at the nozzle 34 after shut-off of the valve 28. In this regard, the air nozzle 44 is delivered to a supply of pressurized air in a controlled fashion by way of a second solenoid operated valve 48. In the illustrated embodiment, pressurized air is fed to the valve 48 from the air inlet 14 and filter 16 by way of a regulator 45 and a lubricator 47. The valve 48 is in turn opened and closed in a controlled fashion by the controller 30, which feeds suitable signals to the valve 48 by way of a cable 50.

Referring now to FIGS. 2 through 5, operation of the foregoing structure will be best understood with reference to operation of a glue nozzle such as the nozzle 34 in the absence of a pressurized air source such as the nozzle 44 and associated structure.

Figure 2:
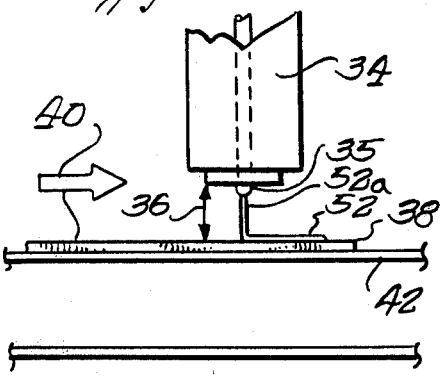
Fig. 2. PRIOR ART
FIG. 2 is an enlarged view of a portion of a prior art apparatus.
Figure 3:
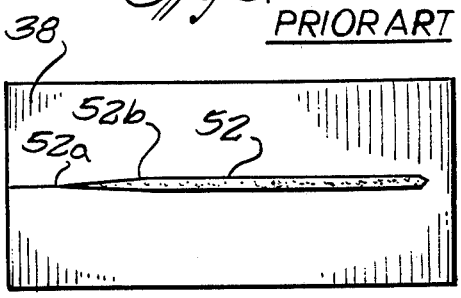
Fig. 3. PRIOR ART
FIG. 3 is an enlarged view of a portion of a workpiece surface illustrating the operation of the prior art apparatus.

Referring initially to FIG. 2 and FIG. 3, in the prior art arrangement the nozzle 34 delivers a stream or bead of glue 52 from its outlet 35 to the surface of the carton 38 spaced a distance 36 therebelow. After the valve 28 (not shown in FIG. 2) has shut off, a remaining quantity of glue 52*a* remains in this space 36, as well as in a portion of the nozzle 34 below the valve 28. This additional quantity of glue 52*a* is thus no longer propelled by the pressure system described above, due to the shutting off of the valve 28. However, the substrate or carton 38 is still being propelled at a substantial speed in a direction 40 by the conveyor 42.

Referring to FIG. 3, it will be seen that as a result of the foregoing conditions, the extra quantity of glue 52*a* is drawn out in a long, thin tail, substantially beyond the desired ending point 52*b* of the bead 52. The tail 52*a* may be either a continuous thin line of glue as shown in FIG. 3 or may be a broken chain of droplets extending for some distance along the line 52*a*. In either case, this tail 52*a* extends considerably beyond the desired termination point 52*b* of the glue bead 52.

It is believed that the continued velocity in the direction 40 of the carton 38 tends to draw the remaining glue portion 52*a* out in this fashion. That is, since the acceleration imparted to the glue portion 52*a* rapidly decreases toward zero upon closing of the valve 28, the moving carton 38 in effect draws out the remaining quantity of glue 52*a* in this fashion. It will be appreciated that as the speed of the conveyor 42 increases, this effect becomes more pronounced.

Figure 4:
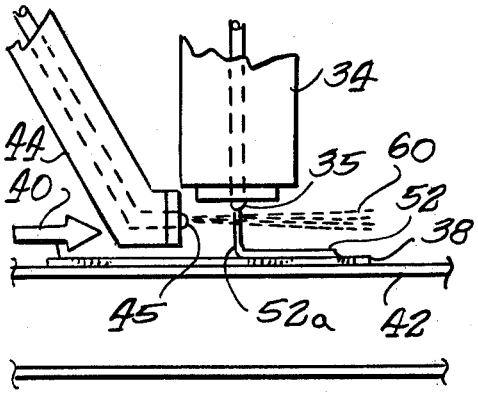
FIG. 4 is an enlarged view of a portion of the apparatus according to the invention, illustrating the improvement thereof over the prior art apparatus of FIG. 2.

Referring now to FIG. 4, the operation of the invention for substantially preventing occurrence of this tail 52*a* is illustrated. As will be described later, the pressurized air control solenoid operated valve 48 is controlled from the controller 30 to deliver a stream of pressurized air 60 at a predetermined time in relation to the closing of the glue valve 28. Hence, the outlet 45 of the air nozzle 44, which is directed substantially normal to the path of the glue in the gap or space 36, delivers a stream of pressurized air in the same direction as the direction of motion 40 of the carton 38 carried on the conveyor 42. This stream of pressurized air tends to impart a horizontal component of acceleration to the remaining quantity of glue 52*a* generally in the direction 40, thus preventing the drawing out of this quantity of glue 52*a* in a long tail as in FIG. 3.

Figure 5:
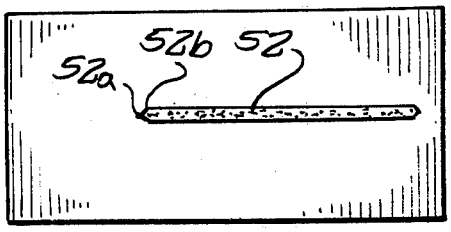
FIG. 5 is an enlarged view of a portion of a workpiece surface illustrating the operation of the apparatus of the invention shown in FIG. 4.

In this regard, it will be seen in FIG. 5 that this additional glue 52*a* forms only a minute extension at the desired glue pattern or glue bead cut-off point 52*b*. It is believed that the acceleration in the direction 40 imparted to the additional glue 52*a* counteracts the otherwise rapidly decreasing acceleration thereof in consequence of the shutting off of valve 28. Accordingly, the glue portion 52*a* is encouraged to more closely approximate the velocity in the direction 40 of the conveyor 42 and substrate or carton 38 carried thereon. Hence, since the velocities of the glue 52*a* and carton 38 are no longer substantially different, the tailing experienced with the arrangement of FIG. 2 and FIG. 3 is substantially eliminated.

Figure 6A:
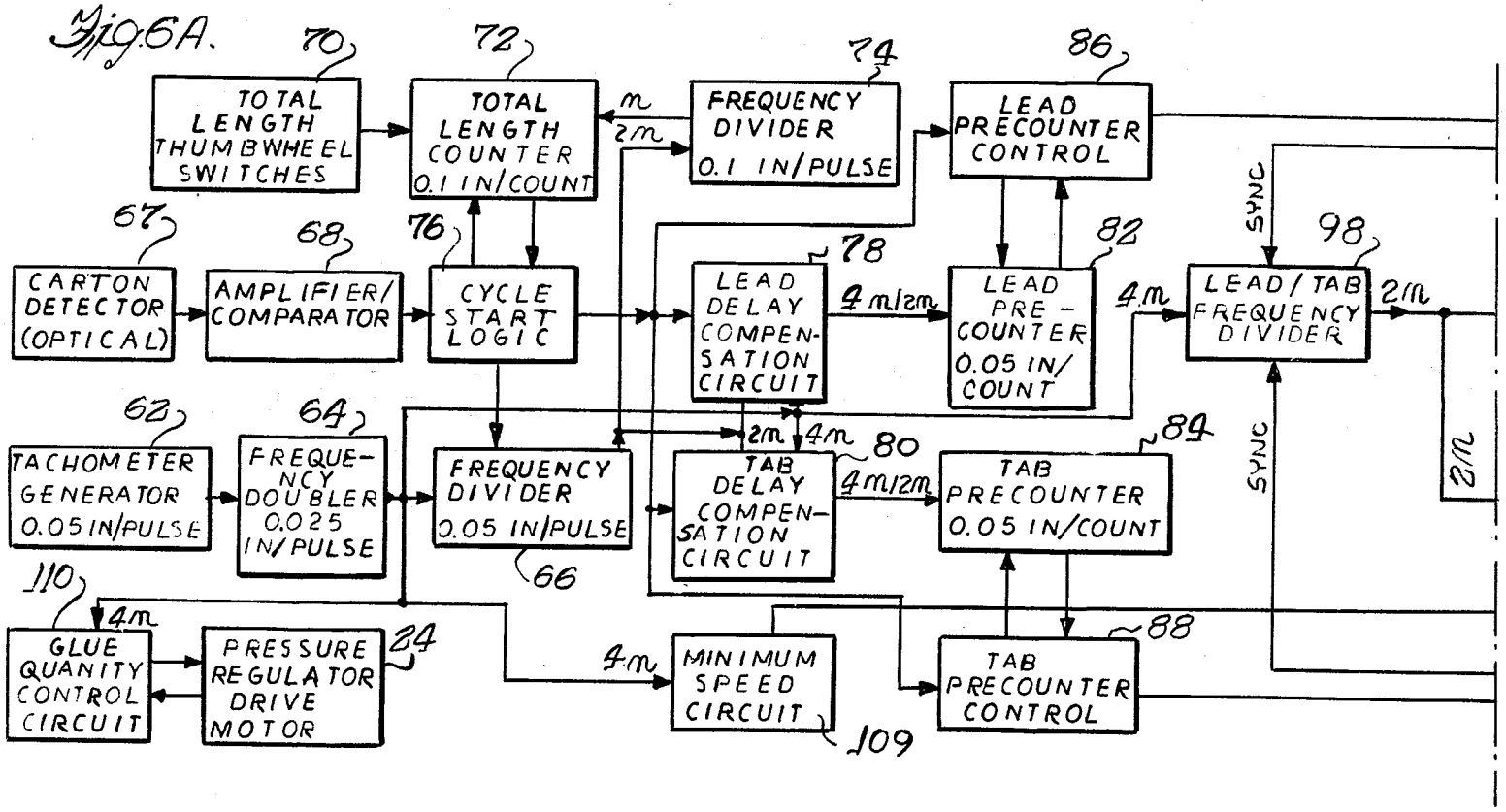
FIGS. 6A and 6B together form a block diagram of a portion of a control system useful with the apparatus of the invention.
Figure 6B:
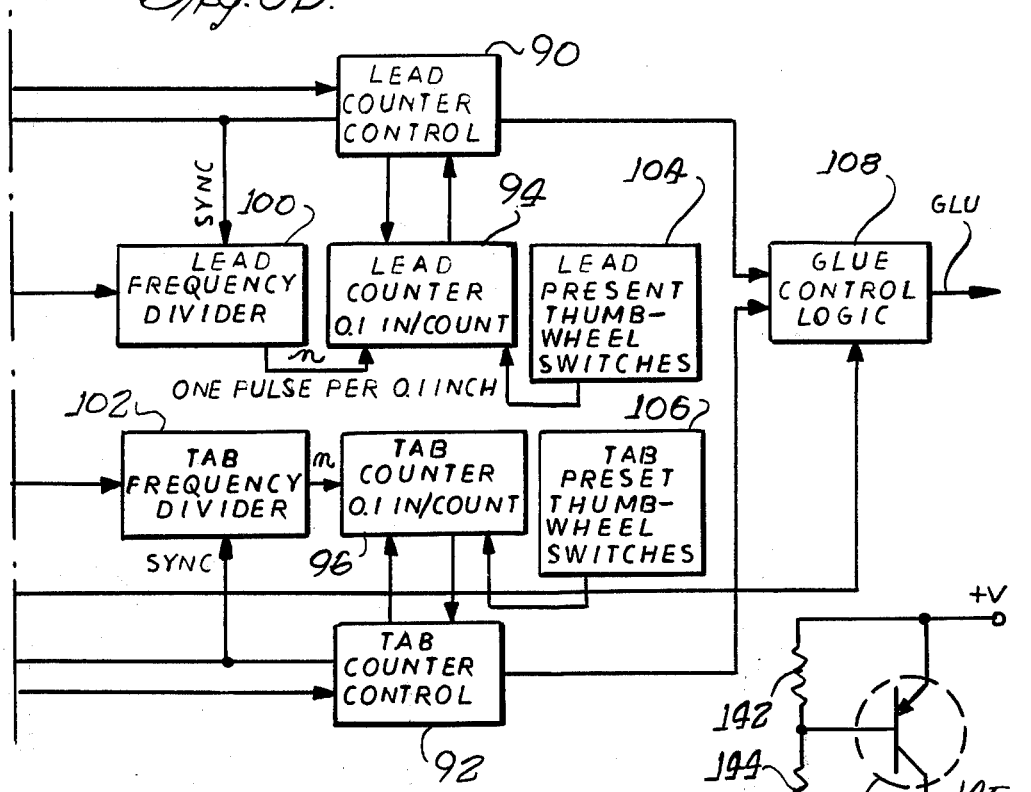
Figure 6B:
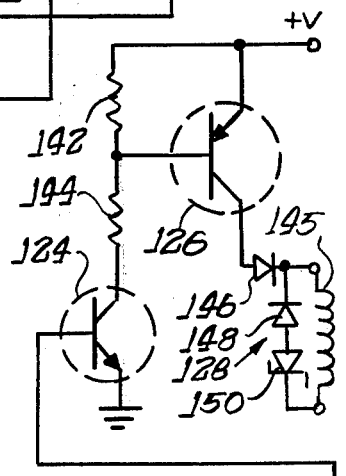

Referring now to FIG. 6, the portion of the controller 30 for controlling the glue valve 28 is shown in block diagrammatic form, which will be useful in understanding the operation of the portion of the controller 30 which operates the pressurized air valve 48, to be described below with reference to FIG. 7 and FIG. 8.

In accordance with conventional practice, the conveyor 42 is provided with a speed transducer or tachometer generator 62, preferably in the form of a rotating body (not shown) frictionally engaged with the conveyor 42. This speed transducer delivers a series of pulse signals at a repetition rate correlative with the speed of the conveyor 42. The pulses from this tachometer generator 62 are fed into a frequency doubler stage 64 whose output is in turn fed into a frequency divider stage 66, the operation of which will be presently discussed.

Also in accordance with conventional practice a carton edge detector or sensor 67 is also provided spaced somewhat ahead (to the left in FIG. 1) of the glue delivery nozzle 34. Preferably, this carton edge detector takes the form of a photoelectric sensor (not shown). The output of the carton edge detector 67 feeds an amplifier/comparator stage 68 which compares the signal level from the photoelectric sensor with some reference point to ensure response thereof only to the passage of a leading carton edge into alignment therewith.

As a verification of the response of the carton edge detector, the total length of each of the cartons 38 carried on the conveyor 42 is set in as a suitable electric signal by way of an operator-accessible control 70. In this regard, it will be recognized that all of the cartons 38 carried on the conveyor 42 will be of substantially the same length in a single run. This total length control feeds a total length counter 72 which in turn receives input pulses from a further frequency divider 74, which is fed from the frequency divider 66, and from the carton edge detector by way of the amplifier/comparator 68 and cycle start logic circuitry 76. In this way, the total length counter 72 and associated cycle start logic 76 recognize and discard any false triggering of the carton edge detector 67. That is, should the carton edge detector be falsely triggered a second time before the conveyor 42 has moved a distance at least as great as the length of a carton 38, this second edge detection signal will be rejected. This may occasionally occur in cartons that have cut-outs or the like along their length.

In order to compensate for the electrical and mechanical delays inherent in opening of the solenoid operated glue valve 28 and in passage of the glue bead through the nozzle 34 and across the gap or space 36, a lead (start) delay compensation circuit 78 is utilized. This circuit 78 receives the divided frequency pulses from the divider 66 and the doubled frequency pulses from the frequency doubler 64 and provides a suitable signal to facilitate opening the valve 28 somewhat earlier to compensate for this delay. In similar fashion, a tab (stop) delay compensation circuit 80 receives the same signals from the frequency doubler 64 and frequency divider 66. This tab delay compensation circuit provides a similar compensation function for the closing of the valve 28, which it will be recognized also involves a similar time delay before closing of the valve 28 and cutoff of the glue bead in the nozzle 34 and space 36. It will be recognized that the greater the velocity of the conveyor 42 and hence carton 38, the greater the compensation which must be provided for the relatively fixed delay times involved in operation of the valve 28 in the travel of glue therefrom, across the distance space 36, to the surface of the carton 38.

In this regard, the pulses received from the tachometer generator 62 by way of the frequency doubler 64, frequency divider 66 and respective compensation circuits 78, 80 are counted by a pair of precounter circuits 82, 84. In principle, these circuits count simultaneously. However, the delays are compensated for by feeding pulses at the rate of the frequency doubler to each of these counters for a time interval sufficient to accumulate a count which represents the movement of the conveyor 42 a distance corresponding to the respective delay times for both opening and closing of the valve 28. Hence, an increased count, to compensate for these delay times, is fed into the precounters 82 and 84 during the time the leading edge of the carton 38 travels from the carton edge detector or sensor 66 to the glue valve 34.

Each of the lead and tab precounters 82 and 84 has a predetermined maximum count in this regard, selected so that the leading edge of the carton 38 will just come in registry with the orifice 35 of the glue nozzle 34 when this maximum count is reached. However, the foregoing compensation arrangement results in this maximum count occurring somewhat earlier than this. Thereupon, corresponding lead and tab precounter control units 86 and 88 will signal corresponding lead and tab counter control units 90, 92. In response to this signal these lead and tab counter control units 90 and 92 will signal associated lead and tab counter units 94 and 96 to begin receiving the tachometer generator pulses by way of a suitable series of frequency dividers 98, 100 and 102. At this point the delay compensation is automatically carried over to these counters 94, 96.

The operator sets one or more desired points at which glue beads are to be respectively started and ended with respect to the leading edge of carton 38 by using corresponding lead (start) and tab (stop) preset controls 104, 106. The lead and tab counter and counter control units 90, 92 and 94, 96 then function to compare the starting and stopping points selected by the controls 104, 106 with their respective accumulating (and delay compensated) counts. When the count in the lead counter reaches the point set for the beginning of a glue bead in the lead preset control 104, a corresponding glue control logic signal (GLU) is fed out by way of a glue logic control unit 108. Correspondingly, when the preselected ending point of a given glue bead has been reached, the tab counter control 92 causes a corresponding logic signal to be output from the glue control logic 108. In the illustrated embodiment, this glue control logic signal (GLU) goes to a high or logic 1 state for the starting point or, more correctly, valve turn-on point for each glue bead to be delivered to the carton 38 and changes state to a low or logic 0 state for the end of each glue bead, or more correctly, the turn-off point for the valve 28 or to achieve the end of a glue bead.

A minimum speed detector circuit 109 may also be provided to shut down the glue control valve 28 by way of the control logic 108 should the conveyor speed fall below some predetermined minimum speed, for example, should a malfunction occur in the conveyor. Similarly, the tachometer generator pulses are also preferably used to control the glue pressure regulator 24 by way of a suitable glue quantity control interface circuit 110. In this regard, it will be recognized that glue pressure must be advanced somewhat with increasing speeds of the conveyor 42 or conversely, retarded somewhat with decreasing speeds in order to apply substantially the same quantity of glue per unit distance traveled by the carton 38.

The foregoing derivation of the glue control signal (GLU) from the glue control logic 108 is helpful in understanding the control of the air valve 48. While a suitable control signal for initiating operation of the air valve 48 might be derived from another point in the preceding circuits, we have found that the glue control signal (GLU) is suitable for this purpose in the illustrated embodiment.

Figure 7:
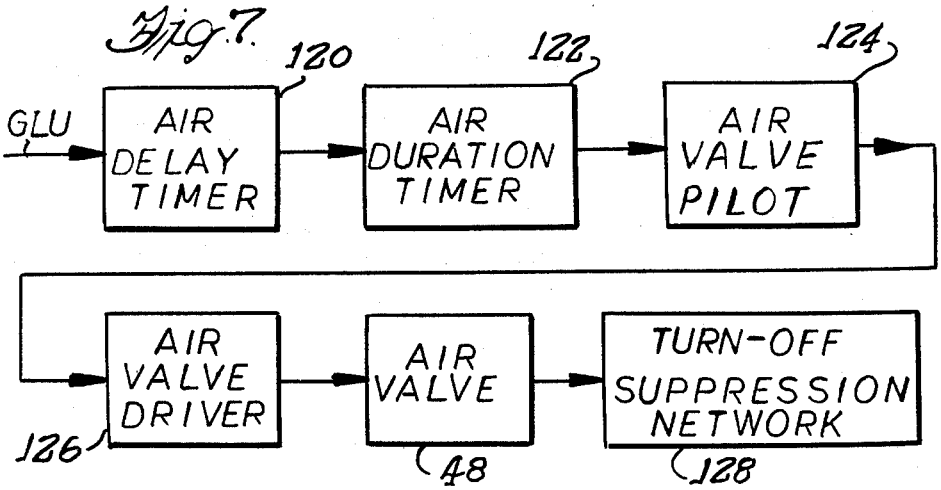
FIG. 7 is a block diagram of an additional portion of a control system useful with the apparatus of the invntion.

Referring initially to FIG. 7 in this regard, this air valve control circuit is shown in block diagram form. The glue control signal (GLU) is fed into an air delay timer circuit 120. Specifically, the delay timer 120 responds to the falling edge of this control signal, that is, the transition thereof from the "glue on" or high logic state to the "glue off" or low logic state, for interposing a further time delay before initiating the air jet or stream of pressurized air at the nozzle 44 by actuating the valve 48 to an "open" condition. This delay is selected to compensate for the time delay in the operation of the glue valve 28, as discussed above, as well as for a similar time delay inherent in the operation of the air valve 48.

In this regard, the timing of the initiation of the air jet from the nozzle 44 relative to closing the glue valve should be such that the air jet will impinge upon the remainer of the glue stream 52*a*, rather than upon the pattern or bead 52 which has just been deposited. Hence, the air jet must be delayed the proper time to compensate for closing of the valve 28. On the other hand, the air jet must be initiated before a tail has begun to form on the carton 38. Accordingly, the air delay timer 120 is set to initiate the air jet from the orifice or nozzle 44 at the proper time in this regard.

The air delay timer 120 also feeds a starting signal to an air duration timer 122 which is set for the desired duration of the air jet from the orifice or nozzle 44. The duration of the air jet should of course be sufficiently long to complete the proper deposit of the remaining glue 52*a* substantially within the glue bead or pattern 52 so as to avoid tailing. However, the duration may be set somewhat higher than the expected time for this to occur in order to assure substantial elimination of any tailing. Beyond this limitation, the duration need only be adjusted to assure that the air jet will be off when the initiation of the next glue bead begins, and this is indicated by the glue control signal (GLU) going high at the input to a delay timer 120, which will automatically reset both the air delay timer 120 and air duration timer 122. The air duration timer 122 in effect passes the "valve open" signal produced by the air delay timer 120 as well as the delayed "valve close" signal to a suitable air valve pilot circuit 124 which in turn actuates an air valve driver circuit 126. This latter air valve driver circuit 126 supplies a suitable voltage and current, stepped up from the logic levels of the preceding circuitry, to the air valve 48. Preferably, a suitable turn-off suppression network 128 is also provided for suppressing voltage transients in the highly inductive solenoid coil utilized to operate the air valve 48.

Figure 8:
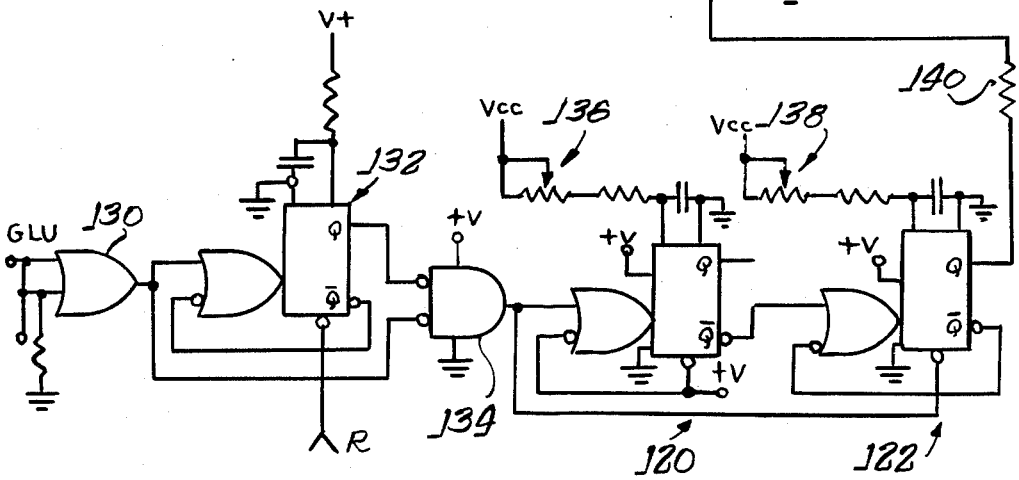
FIG. 8 is a circuit schematic diagram illustrating details of the control system portion of FIG. 7.

Referring now to FIG. 8, the glue control input signal (GLU) feeds a buffer, which in the illustrated embodiment comprises a two-input OR gate 130 having its two inputs tied together. This OR gate 130 feeds a first monostable integrated circuit designated generally 132 which comprises a first stage in a control network for driving the glue valve 28. This monostable 132 may be reset either in response to the glue control signal (GLU) going to its inactive or low state or in response to a current sensing control circuit associated with the glue control valve 28 (not shown) which forms no part of the present invention. In the illustrated embodiment, the circuit of FIG. 8 is illustrated in equivalent form.

The Q output of the monostable circuit 132 and the output of the buffer 130 feed respective inputs of a two-input AND gate 134. The output of this AND gate 134 feeds the air delay timer 120 and air duration timer 122. Each of these timer circuits 120 and 122 comprise a similar monostable integrated circuit. The time delay of the air delay timer monostable 120 is set by an operator-accessible delay control potentiometer 136. Similarly, the duration time of the air duration timer monostable 122 is set by an operator-accessible potentiometer 138. The Q output of the air delay timer monostable 120 feeds the input of the air duration timer 122, while the Q output of this latter monostable 122 feeds the air valve pilot 124, which in the illustrated embodiment comprises a bipolar NPN transistor.

In the illustrated embodiment, the air valve pilot transistor 124 has its base electrode driven from the Q output of the air duration timer monostable 122 by way of a suitable series-connected resistor 140. The emitter electrode of this transistor 124 is tied to ground. The air valve driver 126 takes the form of a power transistor, which in the illustrated embodiment comprises a PNP transistor. The emitter electrode of this driver transistor 126 receives a suitable high voltage supply, while the base electrode thereof is biased on and off from this same high voltage supply by way of junction of a pair of suitable biasing resistors 142, 144. These resistors 142 and 144 are in turn coupled in series with the collector electrode of the pilot transistor 124 for biasing the driver transistor 126 on and off from the high voltage positive supply. The collector electrode of the driver transistor 126 feeds the high voltage input of the solenoid coil 145 of the air valve 48 by way of a suitable series-connected diode 146. The low voltage or ground side of the solenoid coil 145 is coupled with the high voltage side by the suppression network 128, which in the illustrated embodiment comprises a diode 148 and a zener diode 150.

This turn-off suppression network 128 is intended to dissipate the stored energy in the highly inductive solenoid coil 145 to facilitate more rapid turn-off in response to the timing out of the duration monostable 122. In this regard, the zener diode 150 allows the coil voltage to go negative with respect to ground (by a controlled amount so as to limit the stress on the driver transistor 126). The incorporation of the zener diode 150 thus increases the initial rate of energy dissipation in the circuit by inserting an additional fixed voltage drop into the current path. Additionally, when the circulating current being dissipated from the coil 145 upon turn-off falls to the point in which the inductive e.m.f. is lower than the zener voltage of the zener diode 150, the zener diode 150 will stop conducting so that the current immediately falls to zero. Hence, this network permits the current decay to be considerably more rapid and the end point more sharply defined, than with the use of a conventional suppression diode alone in parallel with the coil of the solenoid air valve 48.

In operation, the potentiometers 136 and 138 permit accurate setting of the initiation of the energization of the air valve 48 and the duration of opening thereof. This permits accurate timing of the beginning and duration of the pressurized air stream or air jet 60 in relation to the cut-off of the glue valve 28, compensating for the delays in the respective components associated with both the glue valve 28 and air valve 48, so as to substantially eliminate trailing of the glue bead 52 as described above. While the invention is not so limited, in the illustrated embodiment the pressurized air stream or air jet 60 is delivered at a pressure of from substantially 2 psi to 5 psi.

While the invention has been illustrated and described hereinabove with reference to preferred embodiments, the invention is not so limited. Those skilled in the art may devise various alternatives, changes and modifications upon reading the foregoing. The invention includes such changes, alternatives and modifications insofar as they fall within the spirit and scope of the appended claims.

The invention is claimed as follows:

1. Apparatus for applying a coating to a surface of a workpiece moving in a predetermined direction and comprising: conveying means moving the workpiece in said predetermined direction with the workpiece surface exposed for coating; coating dispensing means having at least one coating outlet spaced in juxtaposition to said surface for dispensing the coating material to said surface as it traverses the coating outlet, dispensing control means operatively coupled with said dispensing means for initiating and terminating the dispensing of coating thereby as predetermined portions of said moving workpiece surface come into operative alignment with said coating outlet during traverse thereby, and air jet means for substantially preventing tailing of said coating on said surface following termination of dispensing thereof as the workpiece with its coated surface continues movement without substantial tailing of the applied coating, said air jet means including nozzle means juxtapositioned to said coating outlet for directing an air jet in the direction of movement of the surface being coated and upon the coating as it issues from the coating outlet so as to impart at least a component of acceleration to said coating in said predetermined direction.

2. Apparatus according to claim 1 and further including air control means for controlling the initiation of said air jet relative to each termination of said dispensing of coating so as to prevent tailing upon each of a plurality of terminations of dispensing of said coating upon a surface of a given workpiece.

3. Apparatus according to claim 2 wherein said air control means comprises air valve means controllable for delivering a substantially continuous stream of pressurized air to said nozzle means and air valve control means for opening and closing said air valve means at predetermined times relative to each termination of dispensing of said coating.

4. Apparatus according to claim 3 wherein said air jet means further includes a source of pressurized air and means for delivering said pressurized air to said air valve means.

5. Apparatus according to claim 1 wherein said dispensing control means comprises coating valve means controllable for delivering said coating to said coating outlet in a substantially continuous stream and coating valve control means for opening and closing said valve as preselected portions of said surface come into alignment with said coating outlet.

6. Apparatus according to claim 5 and further including reservoir means for holding a supply of coating and pump means for delivering said coating from said reservoir means to said valve means.

7. Apparatus according to claim 5 wherein said air control means comprises air valve means controllable to deliver a substantially continuous stream of air to said nozzle means and air valve control means for opening and closing said air valve means, and wherein said air valve control means includes means responsive to said coating valve control means for opening and closing said air valve means at predetermined times relative to each closing of said coating valve means.

8. Apparatus according to claim 7 wherein said coating valve control means includes signalling means for producing a coating valve close signal for closing said coating valve and wherein said air valve control means includes means responsive to said coating valve close signal for opening said air valve.

9. Apparatus according to claim 8 wherein said air valve control means further includes adjustable time delay means for delaying the opening of said air valve for a selectable time following production of said coating valve close signal.

10. Apparatus according to claim 9 wherein said air valve control means further includes second adjustable time delay means for delaying the closing of said air valve for a selectable time following the opening thereof.

11. Apparatus according to claim 10 wherein said first and second time delay means are both coupled for response to said coating valve close signal.

12. Apparatus for applying a coating to a surface of a workpiece moving in a predetermined direction and comprising: conveying means moving the workpiece in said predetermined direction with the workpiece surface exposed for coating, coating dispensing means having at least one coating outlet spaced in juxtaposition to said surface for dispensing a stream of coating to said surface as it traverses the coating outlet, dispensing control means operatively coupled with said dispensing means for initiating and terminating the dispensing of said stream of coating as predetermined parts of said moving workpiece surface come into operative alignment with said coating outlet and means proximate to the coating outlet for coacting with said stream of coating issuing therefrom by imparting thereto a component of acceleration in the said predetermined directional movement of the workpiece surface under influence of the conveying means for substantially preventing tailing of said stream of coating following termination of dispensing thereof.

13. Apparatus according to claim 12 wherein said dispensing control means comprises coating valve means controllable for delivering said coating to said coating outlet in a substantially continuous stream and coating valve control means for opening and closing said valve as preselected portions of said surface come into alignment with said coating outlet.

14. Apparatus according to claim 13 wherein said coating valve control means includes signalling means for producing a coating valve close signal for closing said coating valve and wherein said air valve control means includes means responsive to said coating valve close signal for opening said air valve.

15. Apparatus according to claim 14 wherein said air valve control means further includes adjustable time delay means for delaying the opening of said air valve for a selectable time following production of said coating valve close signal.

16. Apparatus according to claim 15 wherein said air valve control means further includes second adjustable time delay means for delaying the closing of said air valve for selectable time following the opening thereof.

17. Apparatus according to claim 16 wherein said first and second time delay means are both coupled for response to said coating valve close signal.

18. Apparatus for applying a glue bead to a surface of a workpiece moving in a predetermined direction and comprising: conveying means moving the workpiece in said predetermined direction with the workpiece surface exposed for application of the glue bead thereto, glue dispensing means having at least one glue outlet spaced in juxtaposition to said surface, dispensing control means operatively coupled with said dispensing means for initiating and terminating the dispensing of glue thereby as predetermined portions of said moving workpiece surface come into operative alignment with said glue outlet during traverse thereby, and air jet means for substantially preventing tailing of said glue on said surface and including nozzle means substantially at the egress end of said glue outlet for directing an air jet in the direction of movement of the surface and across the glue stream issuing from the glue outlet for imparting at least a component of acceleration to the issuing glue stream in said predetermined direction.

19. Apparatus according to claim 1 wherein said nozzle means is positioned for directing said air jet upon the coating in a direction substantially normal to the direction of the coating as it leaves the coating outlet.

* * * * *